US006153564A

United States Patent [19]

Arunasalam et al.

[11] Patent Number: 6,153,564

[45] Date of Patent: Nov. 28, 2000

[54] LUBRICATING OIL COMPOSITIONS

[75] Inventors: Velautha-Cumaran Arunasalam, Chertsey; Ian A. W. Bell, Oxon; John A. Cleverley, Oxfordshire, all of United Kingdom; Ronald P. Wangner, Garden City, N.Y.

[73] Assignee: Infineum USA L.P., Linden, N.J.

[21] Appl. No.: 09/335,126

[22] Filed: Jun. 17, 1999

[30] Foreign Application Priority Data

Jun. 17, 1998 [GB] United Kingdom ..... 9813070

[51] Int. Cl.[7] ..... C10M 135/18; C10M 137/10

[52] U.S. Cl. ..... 508/363; 508/369

[58] Field of Search ..... 508/363, 369

[56] References Cited

U.S. PATENT DOCUMENTS

| | | | |
|---|---|---|---|
| 2,951,040 | 8/1960 | Hugel et al. . | |
| 3,297,573 | 1/1967 | Hain et al. | 508/369 |
| 3,419,589 | 12/1968 | Larson et al. . | |
| 3,840,463 | 10/1974 | Froeschmann et al. . | |
| 4,466,895 | 8/1984 | Schroeck | 508/369 |
| 4,588,829 | 5/1986 | Pan et al. . | |
| 4,966,719 | 10/1990 | Coyle et al. . | |
| 4,978,464 | 12/1990 | Coyle et al. . | |
| 5,494,608 | 2/1996 | Kamakura et al. | 508/363 |
| 5,627,146 | 5/1997 | Tanaka et al. | 508/363 |
| 5,814,587 | 9/1998 | Vrahopoulou et al. | 508/363 |
| 5,837,657 | 11/1998 | Fang et al. | 508/369 |
| 5,888,945 | 3/1999 | Stiefel et al. | 508/363 |
| 5,895,779 | 4/1999 | Boffa | 508/555 |
| 5,906,968 | 5/1999 | McConnachie et al. | 508/363 |
| 5,916,851 | 6/1999 | Hosonuma et al. | 508/363 |

FOREIGN PATENT DOCUMENTS

| | | |
|---|---|---|
| 417 972 A1 | 3/1991 | European Pat. Off. . |
| WO 89/12668 | 12/1989 | WIPO . |
| WO 98/26030 | 6/1998 | WIPO . |

OTHER PUBLICATIONS

"Identification and characterization of trinuclear Molybdenum–Sulfur Clusters by fast Atom Barbardement (FAB) Mass Spectrometry" by K. Hegetschweilr et al., *Inorganic Chemistry*, vol. 30, No. 4, Feb. 20, 1991, pp. 873–876.

*Primary Examiner*—Jacqueline V. Howard

[57] ABSTRACT

A lubricating oil composition is provided comprising a major amount of an oil of lubricating viscosity and a minor amount of, as an additive, at least one compound comprising a metal core and bonded thereto one or more ligands capable of rendering the compound oil-soluble or oil-dispersible, at least one ligand having at least two hydrocarbyl groups of which one has 1 to 7 carbon atoms and the other or another has more carbon atoms.

20 Claims, No Drawings

LUBRICATING OIL COMPOSITIONS

FIELD OF THE INVENTION

The present invention relates to lubricating oil compositions and concentrates therefor containing metal core compounds.

BACKGROUND OF THE INVENTION

Certain oil-soluble or oil-dispersible metal core compounds, ie compounds having a metal core bonded to one or more ligands, are known as additives (or additive components) for lubricating oil compositions (or lubricants) for improving the composition's properties and performance. The ligand or ligands confer oil-solubility on the compound. For example, certain oil-soluble molybdenum- and sulfur-containing compounds have been proposed and investigated as lubricant additives. U.S. Pat. Nos. 2,951,040; 3,419,589; 3,840,463; 4,966,719; 4,995,996; and 4,978,464 are representative of patent specifications describing molybdenum- and sulfur-containing compounds.

Molybdenum compounds for use as lubricant additives described in the art are principally dinuclear molybdenum compounds, characterised by the oxidation state Mo(V). However, International Patent Application No. PCT IB97/01656 describes use of trinuclear molybdenum compounds as lubricant additives, i.e. characterised by a different oxidation state (Mo(IV)); trinuclear molybdenum compounds have improved properties as lubricant additives compared with dinuclear molybdenum compounds, as evidenced by test results in the above International Patent Application, thus ameliorating the problem of providing improved lubricant performance in response to demands from original equipment manufacturers (OEM's).

The above International Patent Application describes, as compounds use as additives in lubricating oil compositions and/or concentrates therefor, those that have the formula $Mo_3S_kL_n$ or mixtures thereof, wherein L represents a ligand which is independent from other ligands represented by L when n is more than 1;

n is in the range from 1 to 4; and k is at least 4, for example in the range from 4 to 10, such as 4 to 7, preferably 4 or 7;

or that have the formula $Mo_3S_kE_xL_n$ or mixtures thereof, wherein L and n are defined as above, k is at least 1, E is oxygen or selenium, x is at least 1, and the sum of k and x is at least 4.

It further states that the ligands L may contain organo groups, preferably being hydrocarbyl groups such as alkyl groups.

U.S. Pat. No. 5,627,146 describes the use of ligand chemistry to improve performance of certain molybdenum-core compounds. Thus, it describes a lubricating oil composition which comprises a high VI oil consisting of a mineral oil and/or a synthetic oil having a VI of at least 115 and a viscosity at 100° C. within the range of 2 to 50 cSt and an asymmetric type molybdenum dithiocarbamate expressed by the general formula (1):

(1)

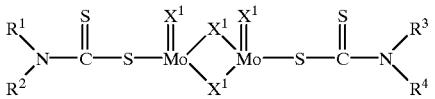

wherein both of $R^1$ and $R^2$ each represent a $C_8$ to $C_{13}$ alkyl group having a branched chain, each of $R^3$ and $R^4$ each represent a $C_8$ to $C_{13}$ alkyl group having a branched chain and/or straight chain, with the provision that none of $R^1$ to $R^4$ are simultaneously the same, and $X^1$ represents a sulfur atom or an oxygen atom. The asymmetry is stated to give performance benefits.

The compounds described in the above U.S. patent are, however, restricted in the number of carbon atoms in their alkyl groups; eg $C_8$ is the minimum and $C_{15}$ is the maximum. This in turn restricts the range of secondary amines, for example, that may be used in the preparation of ligand precursors for the compounds.

The present invention solves the problem by employing groups having less than eight carbon atoms in asymmetric compounds, but without giving rise to undesirably low oil-solubility that might be expected to follow when employing groups with such a low number of carbon atoms. Also, it extends the range of compound types over those described in the U.S. patent, not being restricted to dinuclear molybdenum compounds, and extends the application over those described in the U.S. patent, not being restricted to specific base oils. Moreover, improved antioxidancy performance has been achieved using such asymmetric compounds as additives in lubricating oil compositions.

SUMMARY OF THE INVENTION

In a first aspect, the invention is a lubricating oil composition comprising, or made by mixing, a major amount of an oil of lubricating viscosity and a minor amount of, as an additive, at least one compound comprising a metal core and bonded thereto one or more ligands capable of rendering the compound oil-soluble or oil-dispersible, the or at least one, preferably all, of the ligands containing at least two hydrocarbyl groups of which one has 1 to 7, such as 1 to 5, carbon atoms and the other or another has at least 1, preferably at least 5, such as at least 10, most preferably at least 15, more carbon atoms than said one hydrocarbyl group.

The difference may be, as stated, at least 1 carbon atom, such as at least 2, 3 or 4 carbon atoms, such as, also as stated, at least 5 or at least 10 or at least 15 carbon atoms.

The compound may provide at least 1, for example 1 to 2000, such as 5 to 1000, preferably 20 to 1000, ppm by mass of the metal, expressed as metal atoms, based on the mass of the composition.

Preferably, the metal core, as a metal cluster core comprising more than one metal atom, is of a metal of Group VIA of the Periodic Table, such as a molybdenum core, that may, for example, be dinuclear or trinuclear. It may contain non-metallic atoms consisting wholly or partly of sulphur. Preferably it consists of trinuclear molybdenum and sulphur. The ligands or ligands may, for example, be bidentate ligands, e.g. bonding to the core through two sulphur atoms.

The lubricating oil composition according to the first aspect of the invention has excellent antiwear, antioxidant, and friction-reducing properties; also it may be compatible with other additives used in formulating commercial lubricating oil compositions and can be made from readily available starting materials.

In a second aspect, the invention is an additive concentrate for blending with an oil of lubricating viscosity comprising, or made by mixing, an oleaginous carrier and from 1 to 200,000, for example 50 to 150,00, such as 50 to 100,000, ppm by mass of the metal, expressed as metal atoms, of an additive defined in the first aspect of the invention, based on the mass of the concentrate.

In a third aspect, the invention is a method of lubricating an internal combustion engine comprising operating the engine and lubricating the engine with a lubricating oil composition of the first aspect of the invention.

In a fourth aspect, the invention is use of an additive as defined in the first aspect of the invention for enhancing one or more lubricating oil properties of a lubricating oil composition.

In a fifth aspect, the invention is a method of making a lubricating oil composition or an additive concentrate comprising mixing an additive defined in the first aspect of the invention with an oil of lubricating viscosity or an oleaginous carrier.

In this specification:

"comprising" or any cognate word is taken to specify the presence of stated features, integers, steps or components, but does not preclude the presence or addition of one or more other features, integers, steps, components or groups thereof;

"major amount" means in excess of 50 mass % of the composition;

"minor amount" means less than 50 mass % of the composition, both in respect of the stated additive and in respect of the total mass % of all of the additives present in the composition, reckoned as active ingredient of the additive or additives;

the invention also provides the product obtained or obtainable as a result of any reaction between the various additive components of the composition or concentrates, essential as well as customary and optimal, under the conditions of formulation, storage or use;

"oil-soluble" or "dispersible" used herein do not necessarily indicate that the compounds or additives are soluble, dissolvable, miscible, or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

DETAILED DESCRIPTION OF THE INVENTION

Oil of Lubricating Composition

This oil may be selected from vegetable, animal, mineral, or synthetic oils. The oils may range in viscosity from light distillate mineral oils to heavy lubricating oils such as gas engine oil, mineral lubricating oil, motor vehicle oil, and heavy duty diesel oil. The oils may be unrefined, refined, and re-refined. The oil may be used oil.

In general, the viscosity of the oil ranges from 2 to 30, especially 5 to 20, $mm^2s^{-1}$ at 100° C. The oil may, for example be free of sulfur.

Compounds

Preferably, the hydrocarbyl groups are alkyl (e.g., in which the carbon atom attached to the remainder of the ligand is primary, secondary or tertiary) groups that are independently straight chain or branched. More preferably, all ligands are the same.

Importantly, the hydrocarbyl groups of the ligands have a sufficient number of carbon atoms to render the compounds soluble or dispersible in the oil. The compounds' oil solubility or dispersibility may be influenced by the number of carbon atoms in the ligands. Preferably the ligand chosen has a sufficient number of carbon atoms to render the compound soluble or dispersible in the oil. In the compounds in the present invention, the total number of carbon atoms present among all of the hydrocarbyl groups of the compounds' ligands typically will be at least 21, e.g. 21 to 800, such as at least 25, at least 30 or at least 35. For example, the number of carbon atoms in each alkyl group will generally range between 1 to 100, preferably 1 to 40 and more preferably between 3 and 20.

Said ligand or ligands, may be represented by the formulae:

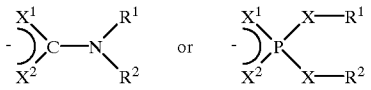

and mixtures thereof, and perthio derivatives thereof wherein X, $X^1$, $X^2$ and Y are independently selected from the group of oxygen and sulfur, and wherein $R^1$ and $R^2$, independently represent said at least two hydrocarbyl groups.

Preferred ligands include dialkyldithiophosphate ("ddp"), xanthates, thioxanthates, dialkylphosphate, dialkyldithiocarbamate ("dtc"), and carboxylate and of these the dtc is more preferred.

The compounds may, for example, have the formula $Mo_3S_kL_n$ or mixtures thereof, wherein L represents said one or more ligands, which is independent from other ligands represented by L when n is more than 1;

n is in the range from 1 to 4; and k is at least 4, for example in the range from 4 to 10, such as 4 to 7, preferably 4 or 7.

Also, the compounds may have the formula $Mo_3S_kE_xL_n$ or mixtures thereof, wherein L and n are defined as above, k is at least 1, E is oxygen or selenium, x is at least 1, and the sum of k and x is at least 4.

The above formulae ($Mo_3S_kL_n$ and $Mo_3S_kE_xL_n$) may each additionally include a moiety $Q_z$ wherein Q represents a neutral electron-donating compound such as water, amines, alcohols, phosphines and ethers, and z is in the range from 0 to 5 and includes non-stoichiometric values.

The $Mo_3S_k$ cores in the above formulae have a net charge of +4. Consequently, in order to neutralize such cores, the total charge among all ligands, L, in $Mo_3S_kL_n$, must be −4. Four monoanionic ligands, L, are preferred. As indicated in the formulae, it is believed that oxygen and/or selenium may be substituted for sulfur in the core. However, in addition to the trinuclear molybdenum, the core should contain at least one, and preferably be primarily (i.e., greater than 50%) sulfur. Most preferred is a core consisting of molybdenum and sulfur alone. The balance, if any, is oxygen and/or selenium.

When the core consists only of trinuclear molybdenum and sulfur it is represented by the formula $Mo_3S_k$, and with ligands attached is represented by the formula $Mo_3S_kL_n$.

The electron-donating compound, $Q_z$, is merely present in the preceding formulae to fill any vacant coordination sites on the trinuclear molybdenum compound.

Those skilled in the art will realise that formation of the compounds will require selection of appropriate ligands having suitable charge to balance the corresponding core's charge, The term "hydrocarbyl" denotes a substituent having carbon atoms directly attached to the remainder of the ligand and which is predominantly hydrocarbyl in character within the context of this invention. Such substituents include the following: (1) hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei, as well as cyclic substituents wherein the ring is completed through another portion of the ligand (that is, any two indicated substituents may together form an alicyclic group); (2) substituted hydrocarbon substituents, that is, those containing nonhydrocarbon groups which, in the context of this invention, do not alter the predominantly hydrocarbyl character of the substituent. Those skilled in the art will be aware of suitable groups (e.g., halo, (especially chloro and fluoro), amino, alkoxyl, mercapto, alkylmercapto, nitro, nitroso, sulfoxy, etc.); (3) hetero substituents, that is, substituents which, while predominantly hydrocarbon in character within the context of this invention, contain atoms other than carbon present in a chain or ring otherwise composed of carbon atoms.

Compounds having the formula $Mo_3S_kL_nQ_z$ have cationic cores surrounded by anionic ligands that may be represented by structures (I) and (II) as depicted below:

(I)

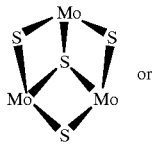

or (II)

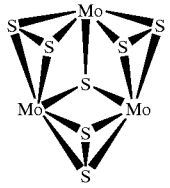

Generally, the trinuclear molybdenum containing compounds can be prepared by reacting a suitable molybdenum source, with a ligand source and, optionally, with a sulfur abstracting agent. This may be carried out in a suitable liquid medium which may be aqueous or organic. Oil-soluble or -dispersible trinuclear molybdenum compounds can be prepared, for example, by reacting in the appropriate solvent (s) $(M^1)_2Mo_3S_{13}.n(H_2O)$, wherein n varies between 0 and 2 and includes non-stoichiometric values, with a suitable ligand source such as a tetraalkylthiuram disulfide. Other oil-soluble or -dispersible trinuclear molybdenum compounds can be formed by reacting $(M^1)_2Mo_3S_{13}.n(H_2O)$, wherein n varies between 0 and 2 and includes nonstoichiometric values, a ligand source such as tetraalkylthiuram disulfide, dialkyldithiocarbamate, or dialkyldithiophosphate, and a sulfur abstracting agent such as cyanide ions, sulfite ions, or substituted phosphines. Alternatively, a trinuclear molybdenum-sulfur halide salt such as $[M^1]_2[Mo_3S_7A_6]$, wherein, A=Cl, Br, or I may be reacted with a ligand source such as a dialkyldithiocarbamate or dialkyldithiophosphate in the appropriate solvent(s) to form an oil-soluble or dispersible trinuclear molybdenum compound. In the above formulae, $M^1$ is a counter ion such as $NH_4$. The trinuclear molybdenum compounds are related by the number of sulfur atoms in the molybdenum core. Within the disclosed range, the number of the sulfur atoms in the core may be altered by the addition of sulfur abstractors such as cyanide and substituted phosphines, or sulfur donators such as elemental sulfur and organic trisulfides to the trinuclear molybdenum compounds.

In general, trinuclear molybdenum compounds can be purified by well known techniques such as chromatography; however, it may not be necessary to purify the compounds.

Composition and Concentrate

The lubricating oil compositions of the present invention may be prepared by adding to an oil of lubricating viscosity a mixture of an effective minor amount of at least one compound, and, if necessary, one or more co-additives such as described hereinafter. This preparation may be accomplished by adding the compound directly to the oil or by first mixing the compound in a suitable carrier fluid to achieve oil solubility or dispersibility, and adding the mixture to the lubricating oil. Co-additives may be added to the oil by any method known to those skilled in the art, either prior to, contemporaneously with, or subsequent to addition of the compound.

Concentrates of the compounds and co-additives, if required, in a suitable oleagenous, typically hydrocarbon, carrier fluid provide a convenient means of handling them before their use. Oils of lubricating viscosity, such as those described above as well as aliphatic, naphthenic, and aromatic hydrocarbons, are examples of suitable carriers for concentrates. These concentrates may contain 1 to 90 mass % of the additives based on the weight of the concentrate; preferred is 1 to 50, more preferably 20 to 70, mass %.

The lubricating oil compositions made by mixing (or blending) an oil of lubricating viscosity containing at least one compound of the types and in the amounts described herein and optional co-additives may be used to lubricate mechanical engine components, particularly of an internal combustion engine such as a spark-ignited or compression-ignition engine, by adding the lubricating oil thereto in the crankcase thereof.

Co-Additives

Other lubricant additives may be used for blending in the compositions of this invention. These include dispersants, detergents, e.g., single or mixed metal detergent systems, pour point depressants, viscosity improvers, antioxidants, surfactants, antiwear agents, and friction reducing agents, These can be combined in proportions known in the art. For example, additives containing phosphorus and/or sulfur compounds such as a zinc dialkyl dithiophosphate(ZDDP) can be prepared and used with the compounds of the present invention. However, the compounds of the present invention may be effective or may even possess improved properties when used in lubricating oil compositions that are free or substantially free of added phosphorus and/or sulfur. i.e., phosphorus and/or sulfur in addition to (i.e., except for) any phosphorus or sulfur contained in the compounds themselves. A lubricating oil composition that is substantially free of phosphorus and/or sulfur is one in which the amount of phosphorus and/or sulfur is not more than is inherently present in base oils of lubricating viscosity.

Particularly noteworthy is the use of anti-oxidants in combination with the compounds.

Examples of suitable antioxidants are selected from copper-containing antioxidants, sulfur-containing antioxidants, aromatic amine-containing antioxidants and phenolic antioxidants.

Examples of suitable copper-containing antioxidants include oil-soluble copper compounds described in EP-B-24 146, EP-A-280 579 and EP-A-280 580. Thus, for example, the copper may be blended into the oil as an oil-soluble copper salt of a synthetic or natural carboxylic acid. Examples of carboxylic acids from which suitable copper salts may be derived include $C_2$ to $C_{18}$ carboxylic acids (e.g., acetic acid, and fatty acids such as stearic acid and palmitic acid), unsaturated acids (e.g., oleic acid), branched carboxylic acids (e.g., naphthenic acids of molecular weight of from 200 to 500, neodecanoic acid and 2-ethylhexanoic acid), and alkyl- or alkenyl-substituted dicarboxylic acids (e.g., polyalkenyl-substituted succinic acids such as octadecenyl succinic acids, dodecenyl succinic acids and polyisobutenyl succinic acids). In some cases, suitable compounds may be derived from an acid anhydride, for example, from a substituted succinic anhydride. The copper antioxidant may be, for example, a copper dithiocarbamate or copper dithiophosphate. Other copper- and sulfur-containing antioxidant compounds, for example, copper mercaptides, xanthates, and thioxanthates, are also suitable for use in accordance with the invention, as are copper sulfonates, phenates (optionally sulfurized) and acetylacetonates. Other copper compounds which may be used in accordance with the invention are overbased copper compounds. Examples of such compounds, and of processes for their preparation, are described in U.S. Pat. No. 4,664,822 and EP-A-0 425 367. The copper compound may be in cuprous or cupric form.

Examples of suitable aromatic amine-containing antioxidants are aromatic amines which have at least one aromatic group directly attached to at least one amine nitrogen atom. Secondary aromatic amines, especially those having two aromatic groups attached to the same amine nitrogen atom, are preferred, but the use of other aromatic amines is not excluded. The amines may contain one or more aromatic groups, for example at least two aromatic groups. Where there are two aromatic groups, both are preferably bonded directly to the same amine nitrogen. Compounds in which two aromatic groups are linked by a covalent bond or by an atom or group (e.g., an oxygen or sulfur atom, or a —CO—, —$SO_2$— or alkylene group) may be used. Aromatic rings, which are preferably aromatic hydrocarbon rings, may be unsubstituted or substituted by one or more substituents selected from alkyl, cycloalkyl, alkoxy, aryloxy, acyl, acylamino, hydroxy, and nitro groups. Amines containing alkyl-substituted aromatic hydrocarbon rings are preferred, especially those containing two alkylsubstituted phenyl groups. Preferred N-aryl amines for use in accordance with the invention are naphthylamines and, especially, diphenylamines, including alkyl substituted diphenylamines, wherein the alkyl group may be the same or different, having 1 to 28 carbon atoms. Other nitrogen-containing antioxidants, for example, phenothiazine type compounds, may also be used in this invention.

Examples of phenolic antioxidants include (a) sterically hindered tertiary-alkylated monohydric phenols such as those described in more detail in U.S. Pat. Nos. 2,944,086; 3,043,775; and 3,211,652; and (b) methylene-bridged tertiary alkyl polyphenols, such as 4,4'-methylene bis (2,6-ditertbutylphenol) and 2,2'-methylene bis (4,6-di-(1,1,2-trimethylpropyl)phenol), and mixtures of (a) and (b) such as those described in more detail in EP-B-0456925.

Examples of sulfur-containing antioxidants (compounds) are alkaline earth metal salts of alkylphenolthioesters having preferably C5 to C12 alkyl side chains, calcium nonylphenol sulfide, ashless oil-soluble phenates and sulfurized phenates, phosphosulfurized or sulfurized hydrocarbons, phosphorus esters and other sulfur-containing molybdenum-containing compounds. Other examples of sulfur-containing antioxidants are metal salts of dihydrocarbyl dithiophosphate or dihydrocarbyl dithiocarbamate compounds, wherein the metal is selected from Zn, Mn, Ni, Al, Group 1 metals and Group 2 metals. Other sulfur-containing compounds include those described in EP-A-699 759, for example, sulfides of oils, fats or polyolefins, in which a sulfur group having two or more sulfur atoms is adjoined and bonded together in a molecular structure. Examples include sulfurized sperm oil, sulfurized pinene oil, sulfurized soybean oil, sulfurized polyolefin, sulfurized esters, dialkyl disulfide, dialkyl polysulfide, dibenzyl disulfide, ditertiary butyl disulfide, polyolefin polysulfide, a thiadiazole type compound such as bis-alkyl polysulfide thiadiazole, and sulfurized phenol.

Preferable antioxidants are copper-containing antioxidants, aromatic amine-containing compounds including diphenylamines and derivatives thereof that have an effect herein comparable to diphenylamines), and mixtures thereof. Examples of copper-containing antioxidants include copper polyisobutylene succinic anhydride ("copper PIBSA") and copper oleate, and diphenylamines include all effective derivatives of diphenylamines.

Thus, the lubricating oil compositions of the present invention may include a minor amount of at least one antioxidant and at least one oil-soluble or oil-dispersible compound. The composition may include a mixture of the compounds and antioxidants of the types disclosed herein, the lubricating oil and/or other additives disclosed herein per se, and/or of any intermediates and reaction products occurring as a result of the mixture. In combination, the antioxidants and compounds are present in a minor effective amount to produce the enhanced lubricating performance, particularly friction reduction, friction reduction retention, antioxidancy and/or antiwear properties in the oil.

EXAMPLES

The invention will be more fully understood by reference to the following examples, in which Example 1 relates to preparation of a compound usable in the present invention and Example P relates to the preparation of a compound for comparison.

Example 1

Preparation of Asymmetric $Mo_3S_7(dtc)_4$

N,N'-Diisopropyl-N,N'-dioctadecyl thiuram disulphide (63.3 g) and toluene (86.5 g) were charged into a 500 ml reaction flask, fitted with stirrer, water condenser, temperature control and nitrogen sparge. This mixture was stirred and ammonium molybdenum polysulphide $\{(NH_4)_2Mo_3S_{13}2H_2O\}$ (25.8 g) and methanol (124.5 g) added. The nitrogen sparge was commenced at a rate of 20 liters per hour. The mixture was slowly heated to 60° C. over 20 minutes and then maintained at this temperature for 12 hours during which time $H_2S$ and $NH_3$ were evolved. The off gases were absorbed in a caustic solution. After 12 hours, the nitrogen sparge was replaced by a nitrogen blanket set at the same rate and ESN150 diluent oil (80.3 g) was added. The apparatus was then changed to a distillation configuration. The mixture was heated from 60° C. to 75° C. in 30 minutes. A vacuum of 500 mbar was then applied and the temperature increased to 125° C. over a 30 minute period. The pressure was then reduced further to 125 mbar absolute and the temperature held at 125° C. for 30 minutes.

On cooling, a dark brown/red moderately viscous, oil-soluble product was obtained which contained 6.34 mass % molybdenum, being a compound represented by the formula $Mo_3S_7(dtc)_4$, where dtc represents a dithiocarbamate ligand in which each N atom is substituted with an isopropyl and an octadecyl group.

Example P

Preparation of Symmetrical $Mo_3S_7(dtc)_4$ Compound as Comparative Example

The procedure of Example 1 was repeated except that, as the thiuram disulphide, there was used tetra-coco thiuram disulphide (72.6 g) and that 89.6 g of ESN150 diluent oil was used.

On cooling a dark brown/red, moderately viscous, oil-soluble product was obtained which contained 5.67 mass % molybdenum, being a compound represented by the formula $Mo_3S_7(dtc)_4$, where dtc represents a dithiocarbamate ligand in which each N atom is substituted with coco groups. "Coco" is an alkyl chain or mixture of chains of varying even numbers of carbon atoms of typically $C_8$ to $C_{18}$.

Each of the products of Examples 1 and P, were blended into fully formulated lubricating oils at concentrations to provide 150 and 500 ppm by mass of molybdenum, expressed as molybdenum atoms, to the oils. The formulations (A to D) of the oils are listed in the table below, where mass %'s of named components are given; also each of A to D contained a dispersant; an overbased Mg sulfonate detergent; a neutral Ca sulphonate; a zinc dialkyl dithiophosphate anti-wear additive; a polyisobutene succinic anhydride; an anti-foam and a viscosity modifier, in the same proportions in each of the oils.

| Oil | Example 1 Product | Example P Product | Diluent Oil |
|---|---|---|---|
| A | 0.237 | | 88.772 |
| B | | 0.265 | 88.744 |
| C | 0.790 | | 88.219 |
| D | | 0.883 | 88.126 |

As noted, oils A and B contained 150 ppm of Mo and oils C and D contained 500 ppm of Mo.

The four oils, A to D, were each tested in a bulk oil oxidation test where air was blown though the oil at a fixed rate while the temperature of the oil was maintained at 165° C. An oxidation catalyst, an oil-soluble iron salt providing 40 ppm of iron, was added at the beginning of the test. Samples of oil were withdrawn periodically and their viscosity measured using a HAAKE viscometer. The degree of oxidation was measured as a percentage viscosity increase, relating the viscosity of the oxidised oil to its original viscosity. The following results were obtained.

| OIL | A | B | C | D |
|---|---|---|---|---|
| Percent Viscosity Increase at 16 hours | 0 | 0 | 0 | 0 |
| Percent Viscosity Increase at 24 hours | 14.2 | 35.3 | 0 | 0 |
| Percent Viscosity Increase at 40 hours | 308.3 | 656.6 | 2.6 | 2.8 |
| Percent Viscosity Increase at 48 hours | 441.0 | — | 63.7 | 70.9 |
| Percent Viscosity Increase at 64 hours | — | — | 578.6 | 680.3 |

• A dash indicates that the product had become too viscous for its viscosity to be measured.

The above results demonstrate that the viscosity increases obtained using the oils containing the asymmetric molybdenum compounds (A and C) are less than those obtained using the symmetrical molybdenum compounds (B and D). This effect is particularly demonstrated using 150 ppm of molybdenum, where the viscosity of Oil A (of the invention) remained measurable for significantly longer than that of Oil C (comparative).

This specification also describes a lubricating oil composition comprising, or made by mixing, a major amount of an oil of lubricating viscosity and a minor amount of, as an additive, at least one compound comprising a metal core and bonded thereto ligands capable of rendering the compound oil-soluble or oil-dispersible, at least one of the ligands containing at least two hydrocarbyl groups differing in their number of carbon atoms by at least 1, preferably at least 5, such as at least 10, most preferably at least 15.

What is claimed is:

1. A lubricating oil composition comprising, or made by mixing, a major amount of an oil of lubricating viscosity and a minor amount of, as an additive, at least one compound comprising a metal cluster core comprising more than one metal atom of Group VIA of the Periodic Table and bonded thereto one or more ligands capable of rendering the compound oil-soluble or oil-dispersible, the or at least one of the ligands containing at least two hydrocarbyl groups of which one has 1 to 7 carbon atoms and the other or another has at least 1 more carbon atoms than said one hydrocarbyl group.

2. The composition of claim 1 wherein the hydrocarbyl groups are alkyl groups that are independently straight chain or branched.

3. The composition of claim 1 wherein said ligand or ligands is or are represented by formulae

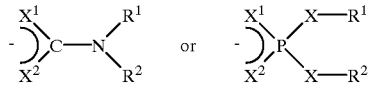

and mixtures thereof, and perthio derivatives thereof wherein X, $X^1$, $X^2$ and Y are independently selected from the group of oxygen and sulfur, and wherein $R^1$ and $R^2$ independently represent said at least two hydrocarbyl groups.

4. The composition of claim 3 wherein the or said at least one ligand is a dialkyl-dithiophosphate or a dialkyldithiocarbamate ligand.

5. The composition of claim 1, wherein the metal core is a molybdenum core.

6. The composition of claim 1 wherein the core contains non-metallic atoms consisting wholly or partly of sulfur.

7. The composition of claim 6 wherein the core consists of trinuclear molybdenum and sulfur.

8. The composition of claim 7 wherein the compound has the formula $Mo_3S_kL_n$ or mixtures thereof, wherein L represents said one or more ligands;

n is in the range from 1 to 4; and k is at least 4.

9. The composition of claim 5 wherein the compound has the formula $Mo_3S_kE_xL_n$ or mixtures thereof, wherein L represents said one or more ligands, n is in the range from 1 to 4, k is at least 1, E is oxygen or selenium, x is at least 1, and the sum of k and x is at least 4.

10. The composition of claim 8 wherein the formula additionally includes a moiety $Q_z$, wherein Q represents a neutral electron-donating compound, and z is in the range from 0 to 5 and includes non-stoichiometric values.

11. The composition of claim 1 wherein the other of said at least two hydrocarbyl groups has from 8 to 100 carbon atoms.

12. The composition of claim 1 wherein the mass of metal from the compound is at least 1 ppm based on the mass of the composition.

13. The composition of claim 1 wherein the total number of carbon atoms in all of the ligands' is at least 21.

14. The composition of claim 1 wherein the oil of lubricating viscosity is free of sulphur.

15. The composition of claim 1 further comprising, or made by mixing, at least one antioxidant additive.

16. The composition of claim 1 further comprising, or made by mixing, one or more dispersants, detergents, pour point depressants, viscosity improvers, surfactants and anti-wear agents.

17. An additive concentrate for blending with an oil of lubricating viscosity comprising, or made by mixing, an oleaginous carrier and from 1 to 200,000 ppm by mass of the metal of an additive as defined in claim 1, based on the mass of the concentrate.

18. An additive concentrate of claim 17 further comprising, or made by mixing, at least one antioxidant additive, whereby the concentrate contains from 1 to 90 mass percent of additives based on the mass of the concentrate.

19. A method of lubricating an internal combustion engine comprising operating the engine and lubricating the engine with a lubricating oil composition as claimed in claim 1.

20. The composition of claim 5, wherein said molybdenum core is a trinuclear molybdenum core.

* * * * *